US006401862B1

(12) United States Patent
Caron

(10) Patent No.: US 6,401,862 B1
(45) Date of Patent: Jun. 11, 2002

(54) STEPLADDER ORGANIZING ASSEMBLY

(76) Inventor: Jean Caron, Cons. 3, Spt Lot 3, P.O. Box 343, Earlton, Ontario (CA), P0J 1E0

( * ) Notice: Subject to any disclaimer, the term of this patent is extended or adjusted under 35 U.S.C. 154(b) by 0 days.

(21) Appl. No.: 09/616,926

(22) Filed: Jul. 14, 2000

(51) Int. Cl.[7] ..... E04G 1/00

(52) U.S. Cl. ..... 182/129; 182/120; 182/121; 248/210

(58) Field of Search ..... 182/120, 121, 182/129, 116; 248/210, 238

(56) References Cited

U.S. PATENT DOCUMENTS

| | | | | | |
|---|---|---|---|---|---|
| 4,874,147 | A | | 10/1989 | Ory et al. | |
| 4,949,925 | A | | 8/1990 | Gorecki | |
| D363,995 | S | | 11/1995 | Mollenhauer | |
| 5,505,302 | A | * | 4/1996 | Ferley | 206/373 |
| 5,603,405 | A | | 2/1997 | Smith | |
| 5,782,314 | A | | 7/1998 | Zeitler | |
| 5,813,530 | A | * | 9/1998 | Kornblatt | 206/373 |
| 5,836,557 | A | | 11/1998 | Bailey et al. | |
| 5,865,409 | A | * | 2/1999 | Nimer | 248/210 |
| 5,901,998 | A | * | 5/1999 | Gallo, Jr. | 294/143 |
| 5,913,380 | A | * | 6/1999 | Gugel et al. | 182/129 |
| 5,941,344 | A | * | 8/1999 | Spadaro | 182/129 |
| 5,967,259 | A | * | 10/1999 | Williams | 182/129 |
| 6,098,748 | A | * | 8/2000 | Harper, Jr. et al. | 182/129 |

* cited by examiner

*Primary Examiner*—Bruce A. Lev

(57) ABSTRACT

A stepladder organizing assembly for increasing a surface area of a head step of a stepladder includes a base portion with a top surface and a bottom surface. A peripheral shoulder is integral to and extends away from each of a plurality of sides. A lip is integral to and extends away from an edge of the shoulder in a direction opposite of the top surface. The shoulder has a plurality of channels therethrough. Straps removably secure the base portion to the head step. At least one tray extension, comprising a block, extends a surface area of the head step. The block has a top wall, a bottom wall, a first side wall and a second side wall. A flange extends away from the first wall. A plurality of protruding members extends away from the flange. The protruding members may be removably placed in the channels.

1 Claim, 4 Drawing Sheets

STEPLADDER ORGANIZING ASSEMBLY

BACKGROUND OF THE INVENTION

1. Field of the Invention

The present invention relates to stepladder tool holding devices and more particularly pertains to a new stepladder organizing assembly for increasing a surface area of a head step of a stepladder.

2. Description of the Prior Art

The use of stepladder tool holding devices is known in the prior art. More specifically, stepladder tool holding devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,782,314; U.S. Pat. No. 4,949,925; U.S. Pat. No. 5,836,557; U.S. Pat. No. 4,874,147; U.S. Des. Pat. No. 363,995; and U.S. Pat. No. 5,603,405.

While these devices fulfill their respective, particular objectives and requirements, the aforementioned patents do not disclose a new stepladder organizing assembly. The inventive device includes a base portion. The base portion has a top surface and a bottom surface. The base portion has two respectively short sides and two respectively long sides. A peripheral shoulder is integral to and extends away from each of the sides and is positioned substantially adjacent to the bottom surface. A lip is integral to and extends away from an edge of the shoulder in a direction opposite of the top surface. The shoulder has a plurality of channels therethrough. A securing means removably secures the base portion to the head step. At least one tray extension extends a surface area of the head step. The tray extension comprises a block. The block has a top wall, a bottom wall, a first side wall and a second side wall. The first and second side walls are opposite walls. A flange is integral to and extend away from the first wall and is positioned adjacent to the top wall. The flange has an upper side and a lower side. A plurality of-protruding members extends away from the lower side of the flange. The protruding members are positioned such that the protruding members may be removably placed in the channels adjacent to one of the sides of the base portion.

In these respects, the stepladder organizing assembly according to the present invention substantially departs from the conventional concepts and designs of the prior art, and in so doing provides an apparatus primarily developed for the purpose of increasing a surface area of a head step of a stepladder.

SUMMARY OF THE INVENTION

In view of the foregoing disadvantages inherent in the known types of stepladder tool holding devices now present in the prior art, the present invention provides a new stepladder organizing assembly construction wherein the same can be utilized for increasing a surface area of a head step of a stepladder.

The general purpose of the present invention, which will be described subsequently in greater detail, is to provide a. new stepladder organizing assembly apparatus and method which has many of the advantages of the stepladder tool holding devices mentioned heretofore and many novel features that result in a new stepladder organizing assembly which is not anticipated, rendered obvious, suggested, or even implied by any of the prior art stepladder tool holding devices, either alone or in any combination thereof.

To attain this, the present invention generally comprises a base portion. The base portion has a top surface and a bottom surface. The base portion has two respectively short sides and two respectively long sides. A peripheral shoulder is integral to and extends away from each of the sides and is positioned substantially adjacent to the bottom surface. A lip is integral to and extends away from an edge of the shoulder in a direction opposite of the top surface. The shoulder has a plurality of channels therethrough. A securing means removably secures the base portion to the head step. At least one tray extension extends a surface area of the head step. The tray extension comprises a block. The block has a top wall, a bottom wall, a first side wall and a second side wall. The first and second side walls are opposite walls. A flange is integral to and extend away from the first wall and is positioned adjacent to the top wall. The flange has an upper side and a lower side. A plurality of protruding members extends away from the lower side of the flange. The protruding members are positioned such that the protruding members may be removably placed in the channels adjacent to one of the sides of the base portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new stepladder organizing assembly apparatus and method which has many of the advantages of the stepladder tool holding devices mentioned heretofore and many novel features that result in a new stepladder organizing assembly which is not anticipated, rendered obvious, suggested, or even implied by any of the prior art stepladder tool holding devices, either alone or in any combination thereof.

It is another object of the present invention to provide a new stepladder organizing assembly which may be easily and efficiently manufactured and marketed.

It is a further object of the present invention to provide a new stepladder organizing assembly which is of a durable and reliable construction.

An even further object of the present invention is to provide a new stepladder organizing assembly which is susceptible of a low cost of manufacture with regard to both materials and labor, and which accordingly is then susceptible of low prices of sale to the consuming public, thereby making such stepladder organizing assembly economically available to the buying public.

Still yet another object of the present invention is to provide a new stepladder organizing assembly which provides in the apparatuses and methods of the prior art some of the advantages thereof, while simultaneously overcoming some of the disadvantages normally associated therewith.

Still another object of the present invention is to provide a new stepladder organizing assembly for increasing a surface area of a head step of a stepladder.

Yet another object of the present invention is to provide a new stepladder organizing assembly which includes a base portion. The base portion has a top surface and a bottom surface. The base portion has two respectively short sides and two respectively long sides. A peripheral shoulder is integral to and extends away from each of the sides and is positioned substantially adjacent to the bottom surface. A lip is integral to and extends away from an edge of the shoulder in a direction opposite of the top surface. The shoulder has a plurality of channels therethrough. A securing means removably secures the base portion to the head step. At least one tray extension extends a surface area of the head step. The tray extension comprises a block. The block has a top wall, a bottom wall, a first side wall and a second side wall. The first and second side walls are opposite walls. A flange is integral to and extend away from the first wall and is positioned adjacent to the top wall. The flange has an upper side and a lower side. A plurality of protruding members extends away from the lower side of the flange. The protruding members are positioned such that the protruding members may be removably placed in the channels adjacent to one of the sides of the base portion.

Still yet another object of the present invention is to provide a new stepladder organizing assembly that is retrofittable to existing stepladders.

Even still another object of the present invention is to provide a new stepladder organizing assembly that contains hooks and ring members for holding of various items.

These together with other objects of the invention, along with the various features of novelty which characterize the invention, are pointed out with particularity in;the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
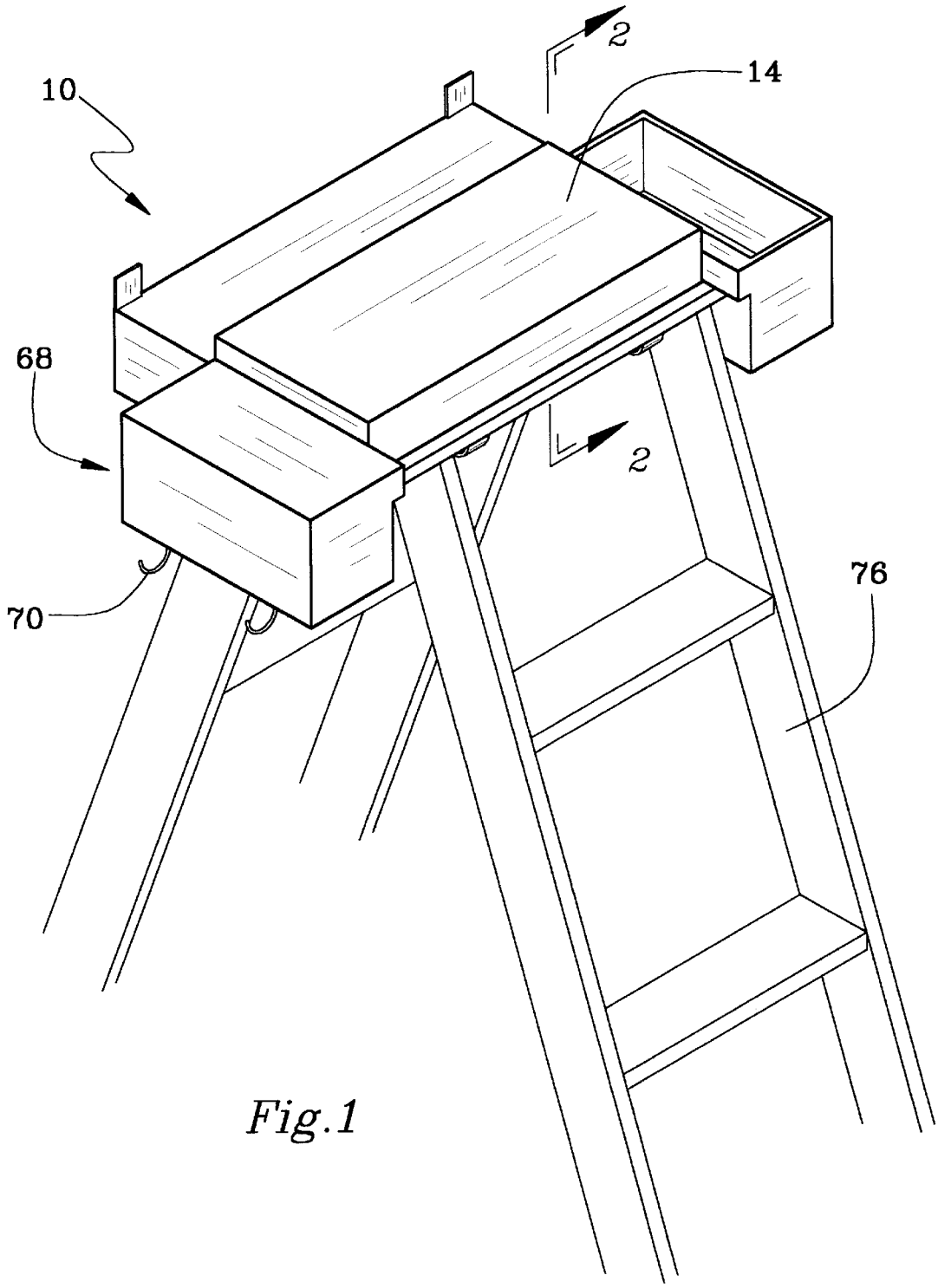
FIG. 1 is a schematic perspective view of a new stepladder organizing assembly according to the present invention.
Figure 2:
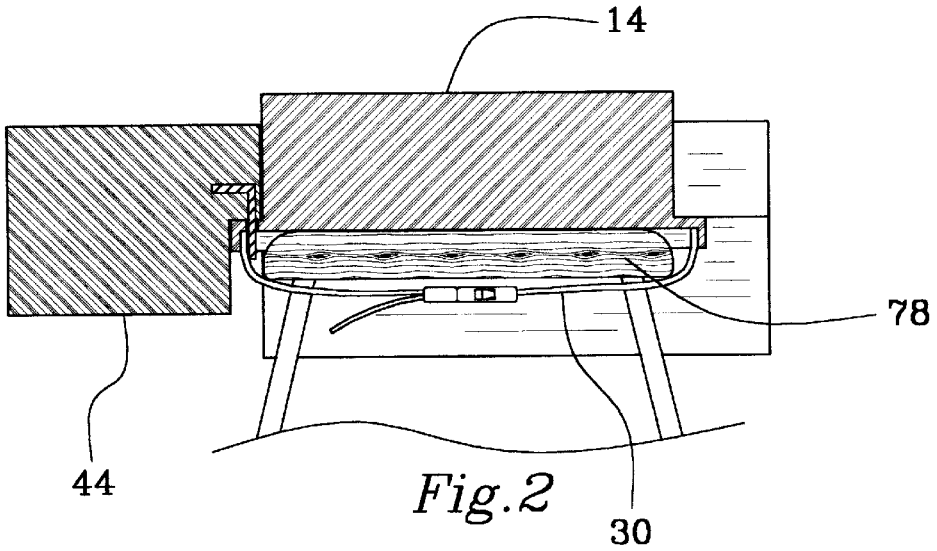
FIG. 2 is a schematic cross-sectional view taken along line 2—2 of the present invention.
Figure 3:
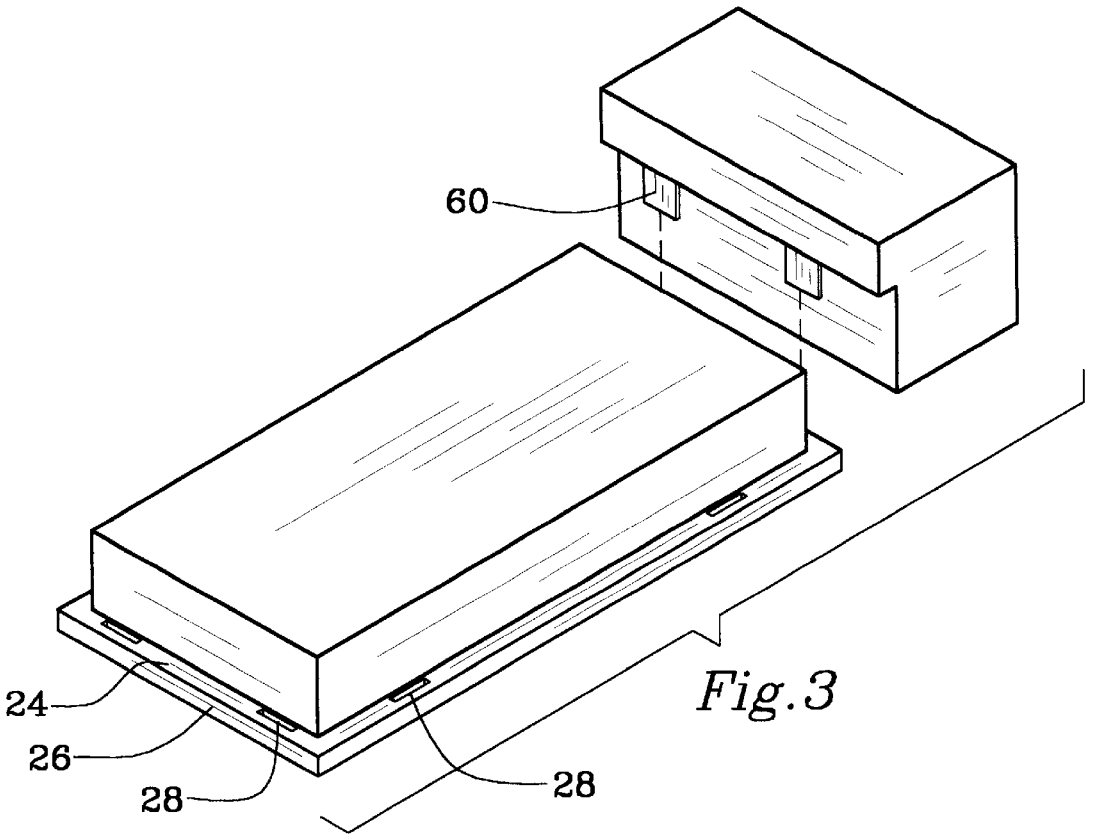
FIG. 3 is a schematic perspective view of the present invention.
Figure 4:
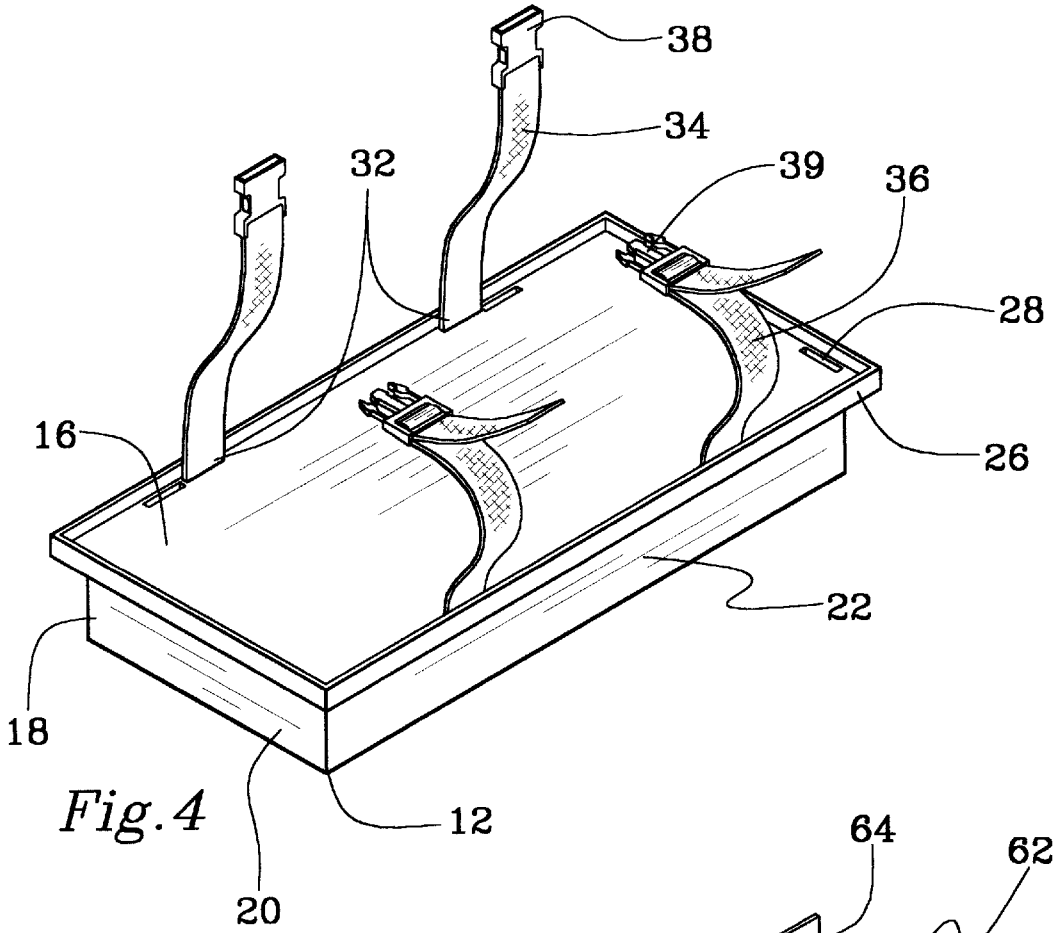
FIG. 4 is a schematic bottom perspective view of the base portion of the present invention.
Figure 5:
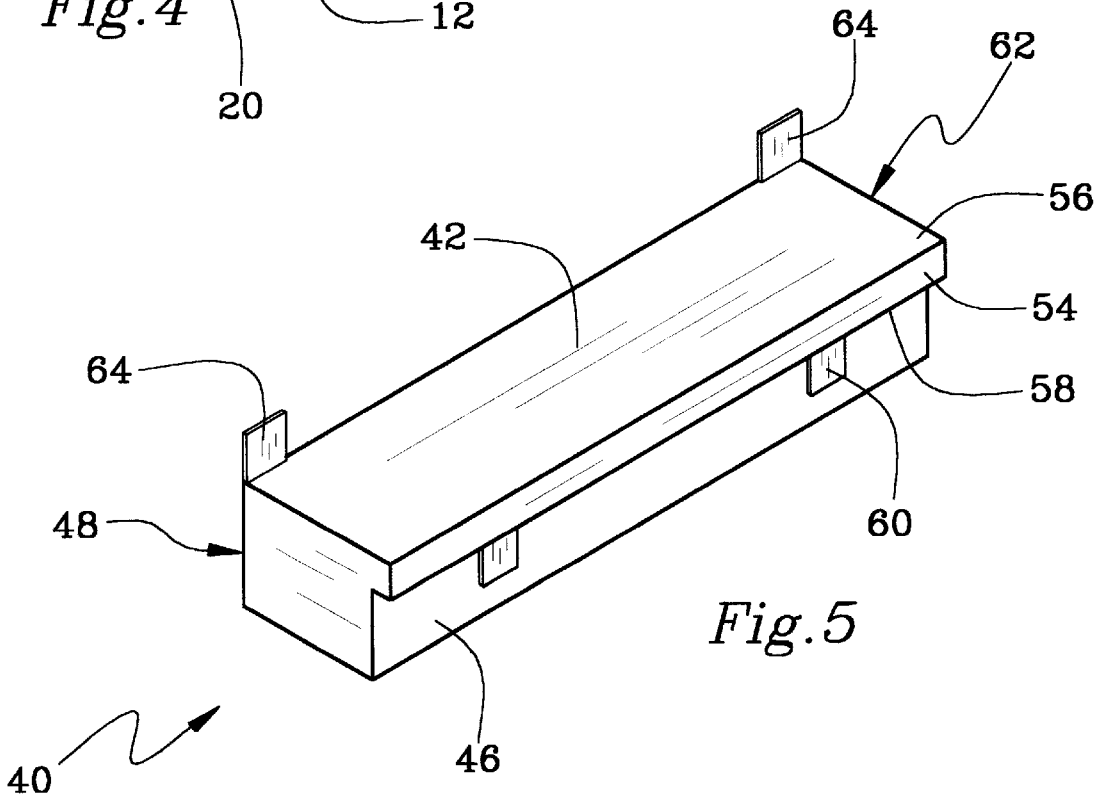
FIG. 5 is a schematic perspective view of a tray extension of the present invention.
Figure 6:
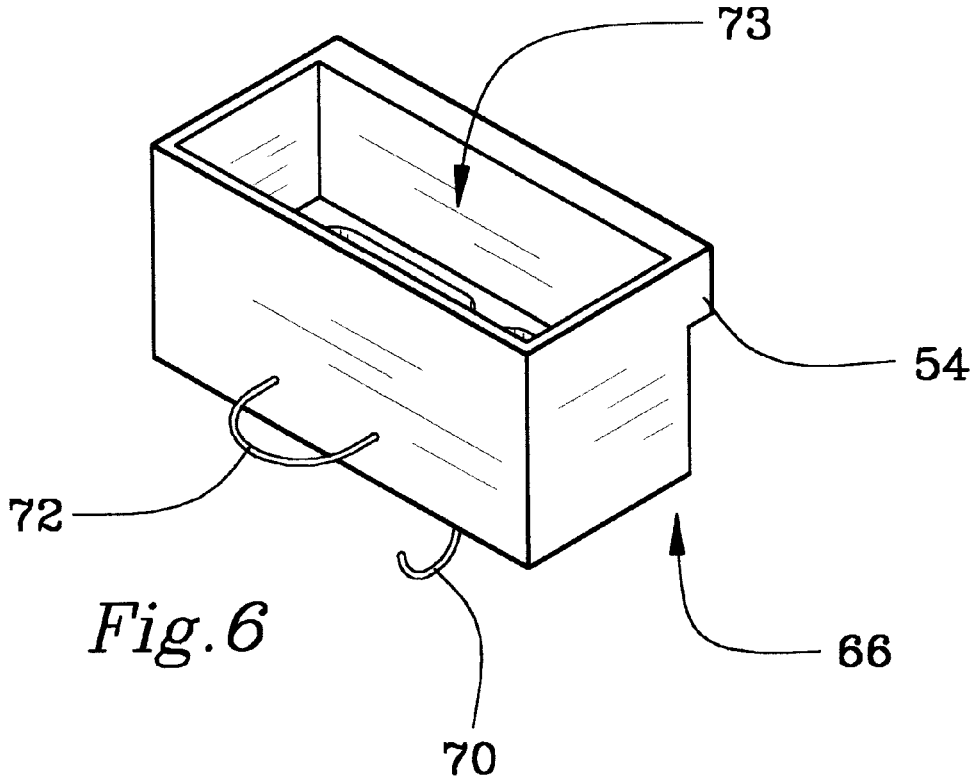
FIG. 6 is a schematic perspective view of a tray extension of the present invention.
Figure 7:
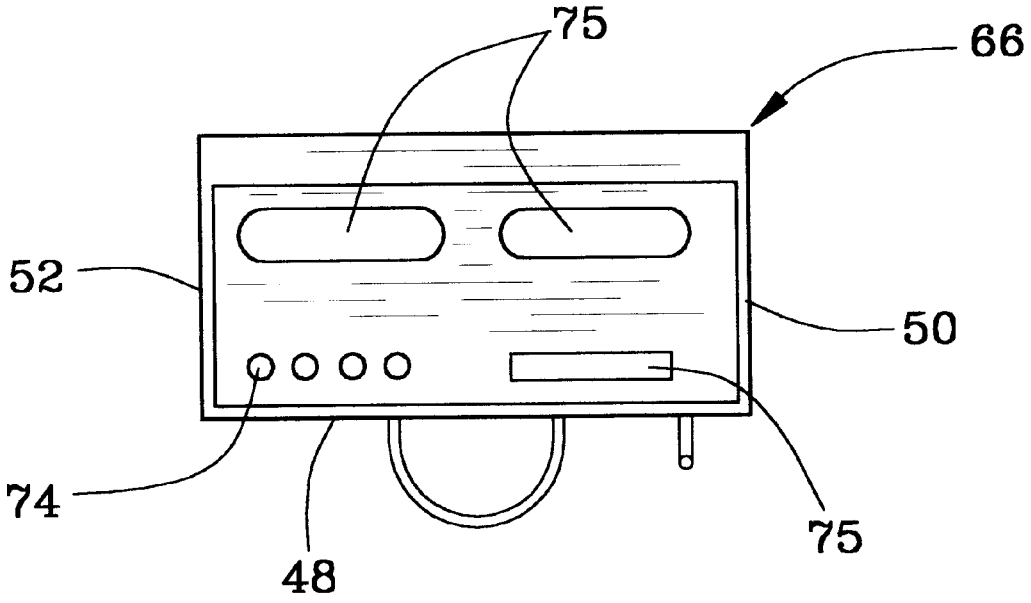
FIG. 7 is a schematic top view of FIG. 6 of the present invention.

With reference now to the drawings, and in particular to FIGS. 1 through 5 thereof, a new stepladder organizing assembly embodying the principles and concepts of the present invention and generally designated by the reference numeral 10 will be described.

As best illustrated in FIGS. 1 through 5, the stepladder organizing assembly 10 generally comprises a base portion 12. The base portion 12 has a top surface 14, a bottom surface 16 and a peripheral wall 18 extending therebetween and integral thereto. The base portion has two respectively short sides 20 and two respectively long sides 22. A peripheral shoulder 24 is integral to and extends away from each of the sides 20, 22 and is positioned substantially adjacent to the bottom surface 16. A lip 26 is integral to and extends away from an edge of the shoulder 24 in a direction opposite of the top surface 14 such that the lip 26 is orientated substantially perpendicular to the shoulder 24. The shoulder 24 has a plurality of channels 28 therethrough. Preferably, two channels 27 are positioned adjacent to each of the sides 20, 22.

A securing means removably secures the base portion 12 to the head step 78 of a stepladder 76. The securing means comprises a pair of straps 30. Each of the straps 30 has a pair of ends 32 securely attached to opposite long edges 22 of the bottom surface 16. Each of the straps 30 has a break therein such that a first 34 and second 36 portion are defined. A buckle means removably coupled the two portions together. Each of the first portions 34 has a free end having a female buckle 38 thereon, and each of the second portions 36 has a free end having a male buckle 39 thereon. The male buckles 39 are adapted to selectively extend a length of the second portions 36. The bottom surface 16 of the base portion may be abutted against the head step 78 such that the straps 30 may be coupled transversely to the head step 78.

A plurality of tray extensions 40 extend a surface area of the head step 78. Each of the tray extensions 40 comprises a block. The block has a top wall 42, a bottom wall 44, a first side wall 46, a second side wall 48, a third side wall 50 and a fourth side wall 52. The first 46 and second 48 side walls are opposite walls and, the third 50 and fourth 52 side walls are opposite walls. A flange 54 is integral to and extends away from each of the first walls 46 and is positioned adjacent to the top wall 42. Each of the,flanges 54 has an upper side 56 and a lower side 58. A pair of protruding members 60 extends away from the lower side 58 of each of the flanges 54. The protruding members 60 are positioned such that the protruding members 60 may be removably placed in a pair of channels 28 adjacent to one of the sides

20, 22 of the base portion 12. The base portion 12 preferably has a height greater than a height of the flanges 54. A first 62 of the tray extensions has a length substantially equal to a length of one of the long sides 22 of the base portion 12. A pair of guard walls 64 extend upwardly from and are integral to the top wall 42 of the first tray extension. The guard walls 64 are positioned generally adjacent to the second wall 48. The guard walls 64 allow pipes to be placed on the first tray extension without fear of the pipes rolling off. Each of a second 66 and third 68 of the tray extensions 40 has a length adapted to be placed on one of the short sides 20 of the base portion 12. Preferably, the second 66 and third 68 tray extensions extend slightly beyond the length of the short sides 20 as is shown in FIG. 1. Each of the second 66 and third 68 tray extensions has at least one hook member 70 securely attached to a bottom wall. The second tray extension 66 has a ring member 72 securely coupled to the second wall. The hook 70 and ring 72 members may be used for holding additional items needed to complete a task. The top wall 42 of the second tray 66 extension has a rectangular depression 73 therein. The depression 73 has a plurality of holes 74 therethrough. The depression 73 also has a plurality of slots 75 therethrough. Tools may be placed in the depression 73 and partially through the slots 75 and holes 74.

In use, the base portion 12 is strapped to the head step 78 and the tray extensions 40 are added as needed. The second tray extension 66 has a depression 73 therein for receiving tools. The heads of screwdrivers and such may be placed through the holes 74 while handles from tool such as hammers may be placed through the slot 75 for easy retrieving.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A stepladder organizing device, said device being removably attachable to the head step of a step ladder for organizing tools and providing additional workspace, said device comprising:

a base portion, said base portion having a top surface, a bottom surface and a peripheral wall extending therebetween and integral thereto, said base portion having two respectively short sides and two respectively long sides, a peripheral shoulder being integral to and extending away from each of said sides and positioned substantially adjacent to said bottom surface, a lip being integral to and extending away from an edge of said shoulder in a direction opposite of said top surface such that said lip is orientated substantially perpendicular to said shoulder, said shoulder having a plurality of channels therethrough, wherein two channels are positioned adjacent to each of said sides;

a securing means for removably securing said base portion to said head step, said securing means comprising a pair of straps, each of said straps having a pair of ends securely attached to opposite long edges of said bottom surface, each of said straps having a break therein such that a first and second portion are defined, each of said first portions having a free end having a female buckle thereon, each of said second portions having a free end having a male buckle thereon, said male buckles being adapted to selectively extend a length of said second portions, wherein said bottom surface of said base portion may be abutted against the head step such that said straps may be coupled transversely to the head step;

a plurality of tray extensions removably mounted on said base portion in positions beside the top surface of said base portion for extending a surface area of the top surface of said base portion, each of said tray extensions comprising a block, said block having a top wall, a bottom wall, a first side wall, a second side wall, a third side wall and a fourth side wall, said first and second side walls being opposite walls and said third and fourth side walls being opposite walls, a flange being integral to and extending away from each of said first walls and positioned adjacent to said top wall, each of said flanges having an upper side and a lower side, a pair of protruding members extending away from said lower side of each of said flanges, said protruding members being positioned such that said protruding members may be removably placed in a pair of channels adjacent to one of said sides of said base portion, said base portion having a height greater than a height of said flanges, a first of said tray extensions having a length substantially equal to a length of one of said long sides of said base portion, a pair of guard walls extending upwardly from and integral to said top wall of said first tray extension, said guard walls being positioned generally adjacent to said second wall, each of a second and third of said tray extensions having a length adapted to be placed on one of said short sides of said base portion, each of said second and third tray extensions having at least one hook member securely attached to a bottom wall, said second tray extension having a ring member securely coupled to said second wall, said top wall of said second tray extension having a rectangular depression therein, said depression having a plurality of holes therethrough, said depression having a plurality of slots therethrough, wherein tools may be placed in said depression and partially through said slots and holes.

* * * * *